US005918328A

United States Patent [19]

Ramsey

[11] Patent Number: 5,918,328

[45] Date of Patent: Jul. 6, 1999

[54] BED ATTACHED SWIVEL SOCKET CRANE LIFT ASSEMBLY

[76] Inventor: Nathan R. Ramsey, 3 Church St., Newmarket, N.H. 03857

[21] Appl. No.: 08/902,536

[22] Filed: Jul. 29, 1997

Related U.S. Application Data

[60] Provisional application No. 60/022,368, Jul. 29, 1996.

[51] Int. Cl.[6] ..... A61G 7/10; A61G 7/14

[52] U.S. Cl. ..... 5/84.1; 5/83.1

[58] Field of Search ..... 5/81.1 R, 83.1–88.1

[56] References Cited

U.S. PATENT DOCUMENTS

| | | | |
|---|---|---|---|
| 4,296,509 | 10/1981 | Simmons et al. | 5/81.1 R |
| 4,571,758 | 2/1986 | Samuelsson | 5/86.1 |
| 5,077,844 | 1/1992 | Twitchell et al. | 5/87.1 |
| 5,367,721 | 11/1994 | Boyles | 5/81.1 R |
| 5,390,380 | 2/1995 | James-Wallace | 5/84.1 |
| 5,459,891 | 10/1995 | Reeve et al. | 5/87.1 |

*Primary Examiner*—Alex Grosz
*Attorney, Agent, or Firm*—Bourque & Associates, P.A.

[57] ABSTRACT

A bedside swivel device is presently disclosed for assisting individuals with physical impairments to maneuver themselves in and out of bed. The bedside swivel device is a swivel socket attached to the side of the bed and is constructed to accommodate various other structures that may be utilized by a physically impaired individual, without the need to take up indispensable floor space that is needed by the wheelchair bound individuals. Such structures include a crane, tables, drawers, sinks, televisions, and the like. Further, the swivel socket and crane combination can be utilized without the need for electricity or any backup power source. Another feature utilizes the disabled individual's physical abilities to the maximum extent possible thereby increasing the individual's health and rate of rehabilitation. In another instance, a power backup source can be supplied with the assembly. The swivel socket and crane are fully mounted to the bed such that the leg and foot support are only for resting and supporting the floor. This mounting structure allows for the device to be moved, in connection and in concert with the bed, to a new position or location.

20 Claims, 6 Drawing Sheets

BED ATTACHED SWIVEL SOCKET CRANE LIFT ASSEMBLY

RELATED APPLICATION

This application claims the benefit of U.S. Provisional Application No.: 60/022,368, filed Jul. 29, 1996.

FIELD OF THE INVENTION

The present invention relates to a device for assisting individuals with physical impairments to transfer themselves to and from a wheelchair to a bed, other wheelchair, commode, shower chair, exercise stimulus bike, toilet seat next to bed or within the bed, or any other piece of equipment utilized by a disabled individual, with or without assistance, particularly mounting the transferring device to the bed, other wheelchair, commode wheelchair, shower chair, exercise stimulus bike, toilet seat next to bed or within the bed, or any piece of equipment utilized by a disabled individual.

BACKGROUND OF THE INVENTION

Many individuals suffer physical impairment from an injury by accidental trauma caused by spinal cord injury or injury to one or both lower extremities or all major extremities. Further, there are individuals who are born with congenital impairments such as being born without one or both lower extremities or any major extremities, cerebral palsy, muscular dystrophy, and other similar disabilities. In all scenarios, the individual's impairment stems from the resulting limitation of use of some extremity requiring the individual to obtain assistance to transfer themselves to and from different environments such as a wheel chair and bed.

In the past, many of the individuals suffering physical impairments have relied upon hired aids, such as nurses, to assist in everyday tasks such as getting in and out of bed and a wheelchair. The cost for this type of assistance is enormous and not affordable to most people. Further, the time consuming burden falls on family or friends and eventually becomes too expensive. Also, the physical exertion required in the lifting process can result in back injuries to the persons engaged in the lifting process. Therefore, there is a need for the individual to be able to perform these daily rituals on their own to save money and prevent personal turmoil.

The prior art discloses several possible solutions to aid physically impaired individuals. Prior art reference Samuelsson, U.S. Pat. No. 4,571,758 describes an apparatus for vertically lifting an individual over a supporting surface. Samuelsson's device describes a cylindrical support column mounted to the ground or floor surface via a base plate. The individual is hoisted from either a bed or wheelchair by a harness means attached to the support arm. Samuelsson, however, does not account for the fact that the cylindrical column must be mounted somewhere near the bed in a position that may get in the way of the person utilizing the support device. Further, Samuelsson's device is bulky, heavy and if the bed to be used by the patient is moved, Samuelsson's device must be unbolted from the floor, moved to the new position and re-bolted in a very secure fashion.

U.S. Pat. No. 4,296,509 to Simmons et al. describes a portable lift wherein an overhead track, in the shape of an extended beam, is supported on each end by two tripod supports. The disabled individual using this device is required to wheel the wheelchair under the track, hook themselves into a harness, raise themselves via a winch, slide themselves across and over to their bed, lower the winch and release themselves into bed. Simmons et al. provides a lightweight, transportable apparatus that allows a physically impaired individual to get in and out of a bed or wheelchair or the like. However, Simmons et al. fails to account for the individual having limited area in a bedroom. Further, trying to reposition the bed and device would require disassembly of the device or several persons to try and move the device and bed together.

U.S. Pat. No. 5,077,844 to Twitchell et al. discloses a mechanical apparatus for lifting and moving humans which is mounted to a wall proximate a bed or the like. The apparatus involves a crane that extends from the bracket mounted to the wall and a harness such that the user can climb into the harness, raise themselves out of a wheelchair, rotate the crane over the bed and lower themselves into the bed. The problem, however, is that this device must be mounted to another vertical surface in such a fashion as to be able to support an individual and the forces involved in moving said individual. Further, if the bed is moved, this assembly must be detached from the wall, moved and reattached in the new location.

Boyles, U.S. Pat. No. 5,367,721 discloses a lifting apparatus and method for transporting a passenger into and out of a swimming pool wherein the device is mounted to the edge of the swimming pool and raises and lowers an individual in a crane-like fashion. This device is not the type of device that would be found inside a home due to its size and weight constraints. Further, the type of foundation needed for this lifting apparatus is not available in most homes without extensive renovation.

U.S. Pat. No. 5,459,891 to Reeve et al. teaches an invalid lift and transport apparatus wherein the apparatus is to be mounted to the floor and the wall via brackets and threaded fasteners. As with the other prior art devices, this device requires physical connecting the device to a structure in the room, near the bed, so as to maintain and support the relative position of the device while in use.

The prior art fails to take into account the fact that an individual may wish to move or relocate their bed. All the prior art devices require mounting systems that will support the weight of the device itself and an individual using the device. The prior art fails to account for the fact that an individual may wish to relocate or reposition their bed. With the prior art devices, this would entail ripping up the floor of their room or their walls. Further limitations arise on positioning the individuals bed, if the device has to be mounted to the floor or walls. In one instance, the bed has to be positioned such that the studs in the walls can be adequately located to mount the device thereto and hence provide the sufficient support for the device. Further, there must be adequate space and foundation in the room to support the device. Therefore, an individual might not be able to position themselves near a window since there might not be the foundation to support the device that is so necessary to their survival. This limitation on the relative positioning of the individual's bed is a major problem not addressed in the prior art.

In addition, existing prior art devices also fail to provide adequate foot room for wheelchair bound individuals to maneuver close to the bed for the purpose of manipulating the crane/lift device, bedside rails, bedside tables, or to reach the covers to make the bed look respectable. Further, the existing prior art devices require that a separate crane be purchased for each bed.

SUMMARY OF THE INVENTION

A bedside swivel device is presently disclosed for assisting individuals with physical impairments to maneuver themselves in and out of bed via an apparatus attached to the side of the bed.

One feature of the invention is that a group of beds, such as may be found in a floor or room of a hospital, can each have swivel sockets mounted thereto and an individual crane can be shared between all the beds in the group. Additionally, the crane is lightweight and can be easily removed. Also, the swivel socket can support other devices such as tables, drawers, sinks, televisions, and the like, without the need to take up indispensable floor space that is needed by the wheelchair bound individuals. Furthermore, the bedside swivel socket and crane combination can be utilized without the need for electricity or any backup power source. This makes the combination extremely efficient, reliable and cost effective for purchase and maintenance. Another feature of the invention is to utilize the disabled individual's physical abilities to the maximum extent possible thereby increasing the individual's health and rate of rehabilitation. In this light, a means to power any of the moving parts of the apparatus is manually operated human power. At periods when this is not readily achievable directly by the individual, an alternative way of storing human power should be considered. Such ways of storing this human power can be achieved by utilizing an exercise pump or blow tube. In this instance, the individual can fill an energy storage source, such as a pressure vessel, battery, fly wheel, fluid reservoir and the like. Further, the means for transferring energy from the associated energy storage source should also maximize the user's potential to the extent possible. All types of energy transfer including, but not limited to, electric, hydraulic, gas and air over oil may be utilized. For instance, if the user can manipulate a lever for raising and lowering a crane, but is having a difficult time rotationally positioning the crane, then a combination of these energy storage and transfer techniques should be considered. For example, the individual user may crank a lever to fill an energy storage. This in turn is used to drive a hydraulic crane to raise and lower a crane boom, a foot plate or a bed. Additionally, the rotation of the crane mast, drawers, sink or any other moving part of the bed can also utilize the human energy stored. The use of such elaborate means of energy storage and transfer gives the individual user a means of exercise. This provides necessary physical and mental benefits by providing the individual user with a sense of accomplishment and self-importance. Further, this energy storage and use system creates a reliable and cost effective system of health care. In another instance, a power backup source can be supplied with the assembly.

The advantages of the invention are that the device and crane are fully mounted to the bed such that the leg and foot support are only for resting and supporting the floor but are not mounted thereto. This mounting structure allows for the device to be moved, in connection and in concert with the bed, to a new position or location. This can be done without the tedious involvement of disconnecting the structure either or both the floor and wall and then reconnecting the structure in a new location to either or both the floor and wall. Further, by not having any connections to either or both the floor and wall, there are no holes to be refilled or fixed. This also provides an easier way of moving the apparatus since the entire structure of the bed and apparatus will move together. If the bed is provided with the proper wheels or bearings for moving, then there should be minimal effort required in repositioning the entire apparatus and bed to a new location.

These and other features and advantages of the present invention will be more clearly understood with reference to a detailed description of an illustrative embodiment taken in conjunction with the accompanying drawings in which:

DETAILED DESCRIPTION

Figure 1:
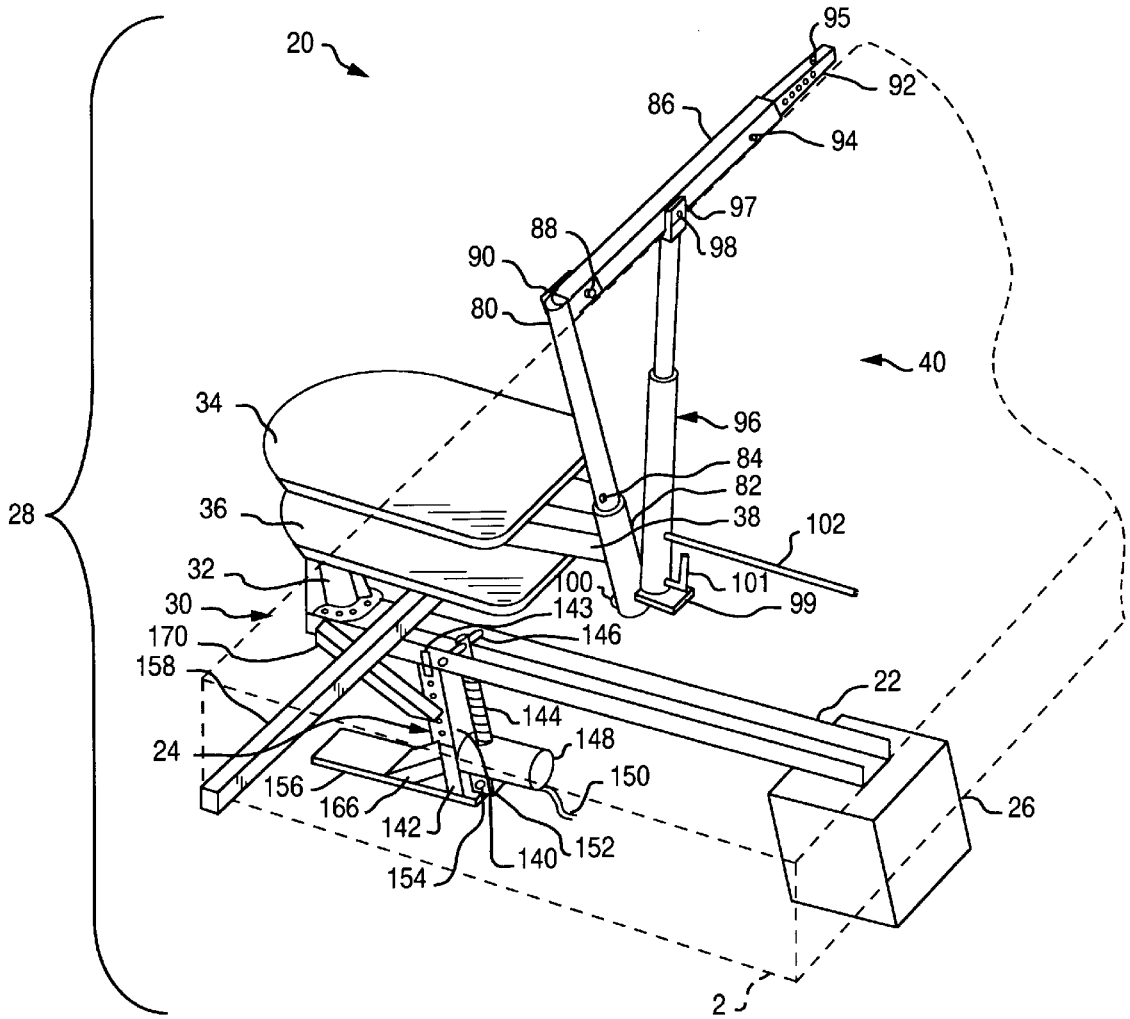
FIG. 1 is a perspective view of the lift assembly depicting the bedside swivel device and associated crane assembly according to the present invention.
Figure 2:
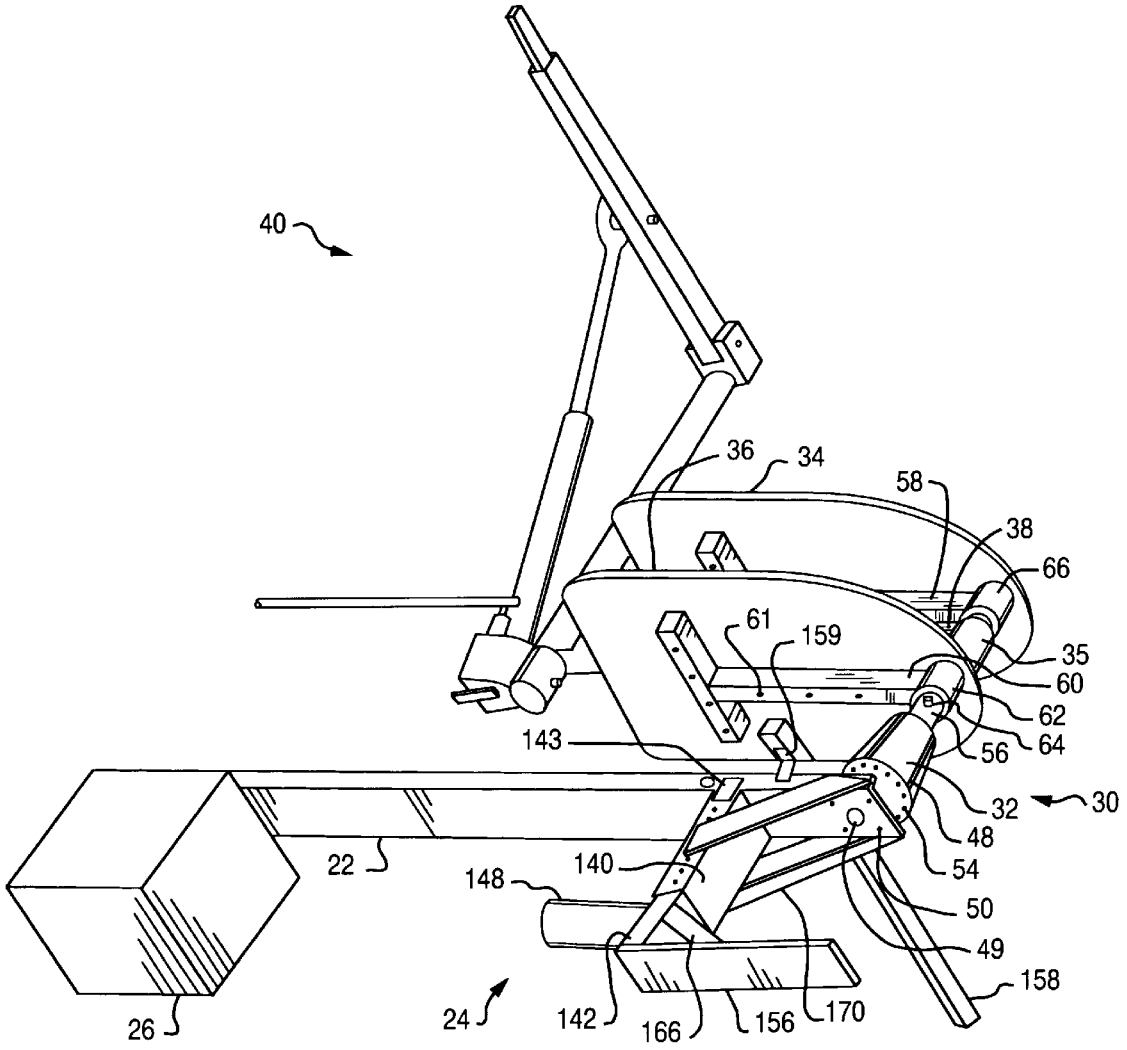
FIG. 2 is a perspective view from the underside of the lift assembly depicting the bedside swivel device and associated crane assembly illustrated in FIG. 1.

Referring to the figures and in particular to FIGS. 1 and 2, a lift assembly 20 is shown. The lift assembly 20 is preferably utilized to provide the necessary assistance for a physically impaired individual to perform the daily task of transferring themselves to and from a bed, wheelchair, commode, shower chair, exercise stimulus bike, toilet seat next to bed or within the bed, or any other piece of equipment utilized by a disabled individual. Further, the lift assembly 20 is mounted to the bed 2 and further does not require the assistance of another individual to operate.

The lift assembly 20 comprises a main channel 22 which connects the assembly to the bed. The main channel 22 extends under and is secured to the underside of the bed. Extending downwardly from the main channel 22 is a base support 24. The base support 24 can be raised or lowered such that it contacts the floor or surface beneath or around the edges of the bed. The base support 24 assists in supporting the lift assembly 20 and aids in preventing the bed from moving or flipping when the lift assembly 20 is in use by an individual.

In an alternative embodiment the main channel 22 has a counterweight 26 connected thereto. The counterweight 26 should be of sufficient size and weight to keep the bed from flipping, rotating or moving in any direction when the lift assembly 20 is in use as is intended. Also the counterweight 26 is to be positioned under the bed to be out of sight and out of the way of the user. The counterweight 26 can be used in connection with the base support or as a substitution thereto. However, the counterweight 26 may not be necessary if the bed structure is of sufficient weight.

Extending upwardly from the main channel 22 is an upper lift assembly 28 which is comprised of: a main axle assembly 30, a main mast swivel socket 32, a main mast 56, an upper table 34, a lower table 36, a main boom 38 and a crane assembly 40. The crane assembly 40 is the actual transference means which transfers the individual to and from the bed and wheelchair.

Figure 4:
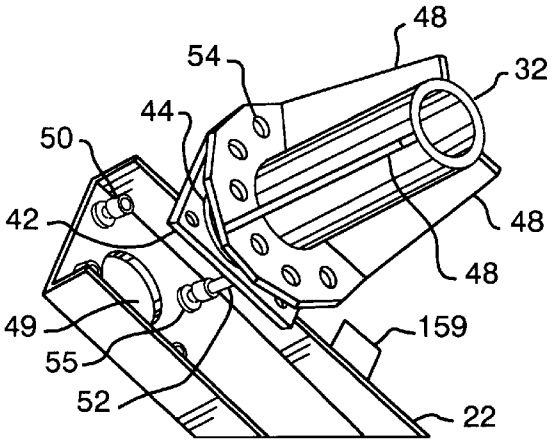
FIG. 4 is a perspective view illustrating the positional relationship between the main axle assembly and main mast swivel socket of FIG. 3 and the main channel.
Figure 6:
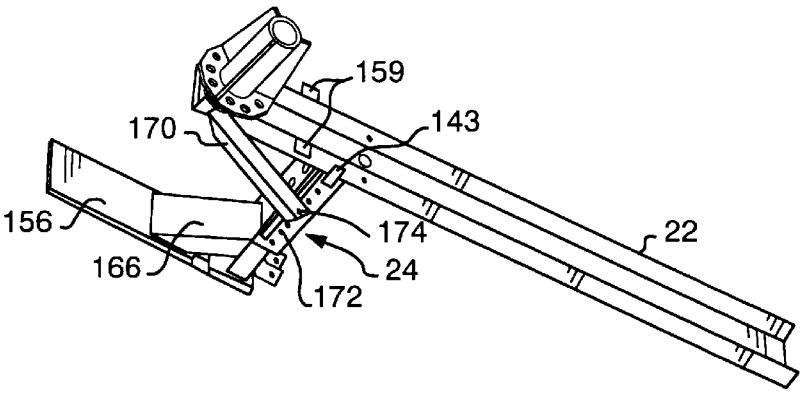
FIG. 6 is a perspective view illustrating the positional relationship between main axle assembly and main mast swivel socket of FIG. 3 and the main channel and base support.
Figure 3:
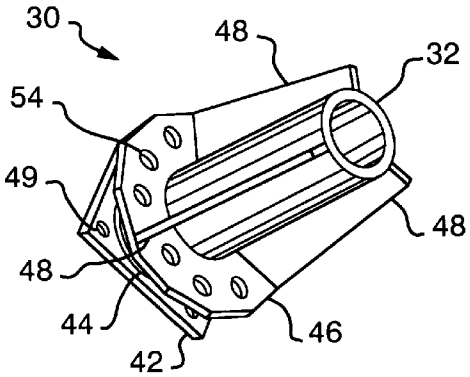
FIG. 3 is a perspective view illustrating the main axle assembly and main mast swivel socket.

FIGS. 3 and 4 illustrate the main axle assembly 30 comprising a mounting surface 42, a rotational bearing assembly 44, a rotational disk 46 upon which said swivel socket 32 is mounted and a plurality of socket support fins 48 are attached to the rotational disk 46. The mounting surface 42 is bolted directly to the main channel 22, through main axle bolt holes 49, which secures the main axle assembly 30 to the main channel 22. Though bolting is disclosed, other means for securing the mounting surface to the main channel can be used such as welding or other types of fasteners.

The rotational bearing assembly 44 is attached to the mounting surface 42 and to the rotational disk 46 thereby allowing the rotational disk 46, and the rest of the main axle assembly 30, to rotate with respect to the main channel 22. In an alternative embodiment, the mounting surface 42, rotational bearing assembly 44 and rotational disk 46, or any combination thereof, can be formed as one unit for ease of manufacture. Attachment of the rotational bearing assembly 46 to the main channel 22, can be done by bolting, welding, a quick release type of bracket for ease of replacement or other connecting means can be used.

The main axle assembly 30 may be made from a tube with a lubricated surface or material such as Teflon. Essentially a bushing can be utilized, instead of bearings, in the main axle assembly 30 or a combination of bearings and bushings may be utilized. In this case a bushing can be used at the top of the socket while a needle thrust washer bearing can be used at the bottom of the socket. For all cases, the design for the main axle assembly 30 to swivel will be determined by the type of application both in the type of foundation structure and the type of supporting member inserted into the socket. In one illustrative embodiment, the main axle assembly 30 is comparable to a bearing type of assembly that can be taken out of the rear axle of a front wheel drive automobile. An axle cap hole 49 is eliminated when a different type of swiveling device is used. If the Teflon bushing and needle thrust bearing is utilized, instead of the rear end axle of a front wheel drive car, then the axle cap hole 49 is not necessary.

In the embodiment illustrated in FIG. 4, the main axle assembly 30 is mounted to the main channel 22 using a main axle mounting bolts 50. Further, a rotational position mounting stop 52 comprises at least one main axle mounting bolt 50 which is of a sufficient length to protrude above the mounting surface 42 of the main axle assembly 30 a distance sufficient to communicate with at least one bolt mounted in a plurality of rotational positioning holes 54, for the purpose of limiting the position of the main boom 38 relative to the main axle assembly 30. The exact rotational limitation is to be determined by the nature of the application of the bedside socket assembly.

In another embodiment, at least one level adjustment washer 55 or spacers are primarily aimed at compensating for any unlevelness in the supporting structure. One added benefit is that in a desirable model, the main axle assembly 30 can be tipped slightly to help the user position himself herself over the desired location with little or no effort required. Here, if a person chiefly uses the crane assembly 40 to get into bed at night then the level adjustment washers can be utilized to tip the main mast 56 toward the desired landing location. This will make it slightly more difficult for the user to get out of bed because the user will then have to swing up hill essentially raising the potential energy.

The plurality of rotational positioning holes 54 and the rotational position mounting stop 52 are primarily utilized as a safety device to insure proper location of patient or user over the correct position of the bed, toilet seat, wheelchair, easy chair, or the like. The patient's position may also be located by a motor which drives the rotation of the main boom 38. This is accomplished by attaching a set of gears to the surface of the rotational disk using the rotational positioning holes 54 and mounting a drive motor to the main channel 22 which meshes with the attached set of gears. Rotational positioning is to be utilized in certain cases to reduce or eliminate the need for various pieces of the assembly. For instance, the counterweight 26 may be reduced if the load is limited in movement to strictly within, or over the area within, the circumference outlined by the structure's supports and a stabilizing foot plate.

The main mast swivel socket 32 is mounted to the rotational bearing assembly 44, such as to extend out from the main channel in a direction away from the floor or ground. One form of mounting includes the use of a plurality of socket support fins 48, however, other mounting means can be substituted hereto in keeping with the scope of the invention. The socket support fins 48 extend outwardly from the rotational bearing assembly 44. Further, socket support fins 48 and main mast swivel socket 32 are welded together. However, a tight flush fit between the fins and the main mast swivel socket 32 can be used so long as the fitting provides adequate stability while the lift assembly 20 is in use.

In one embodiment, three fins are sufficient to keep the relative position of the main mast swivel socket 32 with respect to the main channel 22 and the main boom 38. However, alternate number of fins positioned accordingly around the main mast swivel socket 32 can be used for support. Preferably, the fins' positioning with respect to each other is at equal distance around the swivel socket 32 to provide for maximum support. For example, if three fins are used, they should be positioned at about 12° intervals, if four fins are used, they should be positioned at about 90° intervals, and so forth. The socket support fins 48 may vary in size depending upon supported load and may be eliminated entirely for cases of extremely light loads.

The main mast swivel socket 32 circumscribes and supports a main mast 56 at one end. The main mast extends through the lower table 36, to which it is also rotationally connected. Further, the main mast 56 is connected to the main boom 38 and is further connected at its distal end to the upper table 34. This allows for independent movement on the part of the apparatus attached to the main mast 56. In an alternative embodiment, the main mast swivel socket 32 can be used to support the crane assembly 40 and is designed to accept most existing crane models. For example, a spacer or reducer is utilized when a HOYER LIFTER is inserted into the swivel socket 32.

Figure 8:
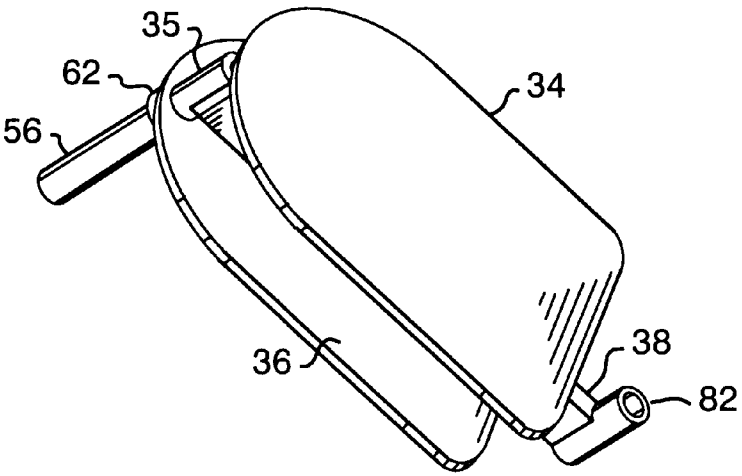
FIG. 8 is a perspective view of the entire table assembly.
Figure 7:
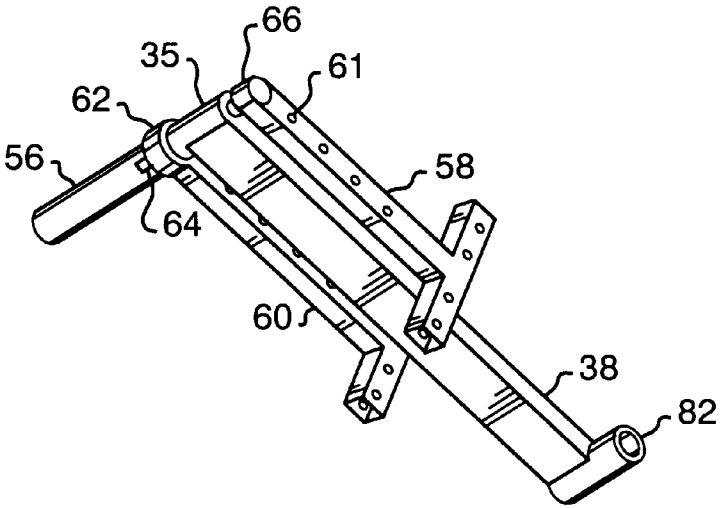
FIG. 7 is a perspective view the upper and lower table supports.
Figure 10:
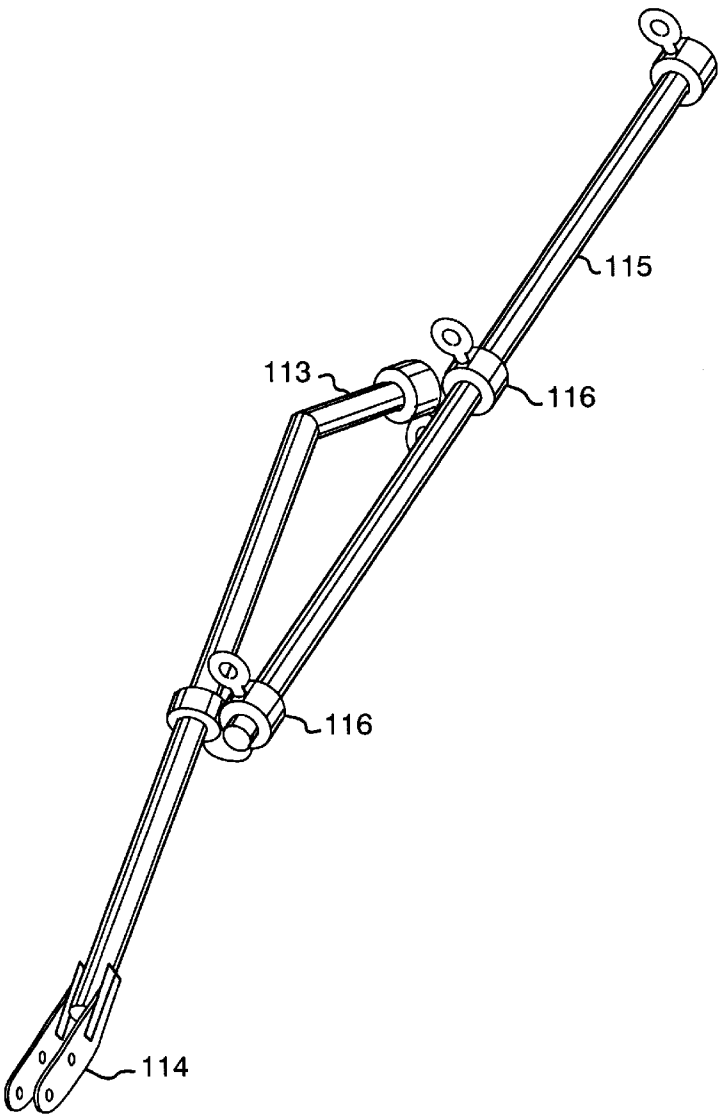
FIG. 10 is a closup perspective view of the crane handle shown in FIG. 9.

FIGS. 7 and 8 illustrate the main boom 38 positioned between the upper table 34 and the lower table 36. The main boom has a first end which comprises a support sleeve 35, which circumscribes the main mast. The upper table 34 is positioned in parallel with respect to the lower table 36 and the relative vertical position of the tables are maintained by a pair of respective table supports 58 and 60 attached thereto via fasteners through at least one of a plurality of holes 61. With respect to the lower table support 60, a support sleeve 62, positioned at one end of the lower table support 60, circumscribes the main mast 56 and is capable of being moved up and down the length of the main mast 56. The support sleeve 62 is positionally maintained by a sleeve bolt 64 passing through the main mast 56. However, pins and telescopic means can be substituted for the sleeve bolt 64 to maintain the relative height or position of the lower table support 60. Further, the upper table support 58 is fashioned with a support shaft 66 at the end which is to connect the upper table support 58 to the main mast 56. The tables are attached to rotate independently around the main mast 56 positioned in the main mast swivel socket 32. The main boom 38 may vary in length, wall thickness, type of material, shapes, and sizes depending on the application. The upper table 36 is limited in motion in the vertical direction as it is mounted at the top of the main mast 56.

The lower table 36 has a special purpose which is to serve as a structure which allows an individual such as a c5-6 quadriplegic the ability to sit themselves up on to his/her elbows by reaching under the table and utilizing his/her biceps. This technique is unique in that without some kind of assistance or device a c5-6 quadriplegic is helpless to sit him or herself up in bed. Further, the tables can provide convenient places to store needed items such as medicine, water, or the like.

THE CRANE:

Illustrated in FIGS. 1 and 2 is the crane assembly 40 which comprises a crane mast 80 rotationally attached near one end to the main boom 38 via a crane mast socket 82. The crane mast 80 can be a cylindrical column or equivalent structure such that its cross sectional dimension is sufficient in size and strength to support the rest of the crane assembly 40 and an individual using the lift assembly 20.

The height of the crane mast 80 can be adjusted telescopically as the crane mast 80 slides through the crane mast socket 82. Once an acceptable height is chosen, a crane mast position stop 84 is shifted into a locking position and the vertical position of the crane mast 80 is fixedly maintained.

A crane boom 86 is pivotally attached to the end of the crane mast 80 distal from where the crane mast socket 82 is attached. Any type of hinging connection can be used to pivotally attach the crane boom 86 including a bolt 88 and mounting bracket 90. However, the desired connection must ensure the mounting bracket 90 allows the crane to be fully collapsible for shipping and aesthetic purposes.

Contained inside the crane boom 86 is a boom extension tube 92 which extends telescopically outwardly from the crane boom 86. Though the boom extension tube 92 is positionally maintained by a bolt or pin 94 that extends through the crane boom, other types of locking means can be used to maintain the relative position of the crane boom extension tube 92. A sling mounting hole 95 is positioned through the end of the crane boom extension tube 92 which extends telescopically outward from the crane boom 86.

A crane jack 96 is mounted to the crane mast 80 at the end of the crane mast socket 82 and is further connected to the crane boom 86 at the upper crane jack mounting bracket 97 via a bolt 98. Though bolts are disclosed, other equivalent positional fixtures such as rivets, welding and the like can be used.

A lower crane jack mounting bracket 99 with a respective bolt 100 and a jack release lever 101 releasably secure the crane jack to the crane mast 80 at a point below the crane mast socket 82. Further, a jack lifting lever 102 can be used by an individual to alter the position of the crane assembly 40.

The crane mast socket 82 is primarily designed to accept the crane mast 80 of a fully collapsible crane which protrudes to either side of the crane boom 86 even though the crane mast 80 typically is fixed in one location. However, it is conceivable to have the crane mast 80 rotate in the crane mast socket 82 allowing additional freedom of movement around obstacles. For instance, if the user needs to have the head of the bed up while getting in and out of the bed, then the second point of rotational freedom is certainly needed. Furthermore, there may be a need to use a second axle or bushing and thrust washer combination in place of the simple stationary crane mast socket design. Additionally multiple main mast assemblies may be extended onto each other to give extra freedom of movement and added mounting room for anything a bedridden person may desire. The main mast 56 is constructed out of solid steel in one embodiment in order for numerous applications to be mounted onto one main mast 56 of the upper lift assembly 28. For instance, the swivel socket 32 and main mast 56 may be utilized to support a set of drawers, multiple swivel tables, a water fountain or bedside sink, intravenous brackets and cranes. Further, other devices can be mounted to the structure without the need to re-design the main mast 56 for structural purposes. That, however, is not to prohibit the re-design in some cases where a lighter model is preferred. In this particular embodiment, three objects can be mounted in a row with three pivot points such that the objects can wrap around or in front of the bed ridden individual and thus making the objects in easy reach of the individual while in one sitting position.

A desirable crane model to be used would be one that can be constructed from various available materials. Further, the crane should be a fully collapsible crane that is less obtrusive and smaller for packaging as a fully assembled unit. If the crane contains a secondary socket, this would provide greater flexibility in positioning and allow for lifting the patient from the side. This in turn makes it possible to lower the overall crane height so that it is less obtrusive and can allow a person in the wheelchair the possibility of seeing art work on the wall behind the bed crane structure.

Figure 9:
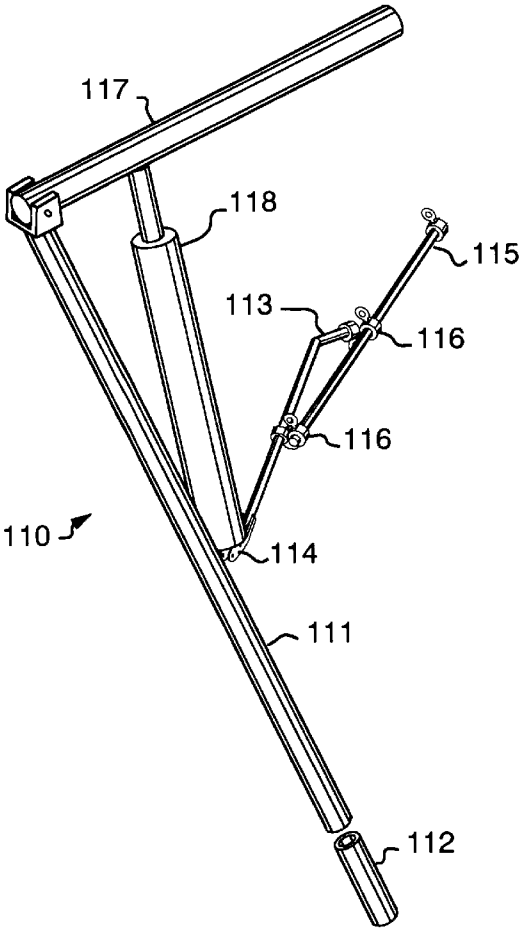
FIG. 9 is a perspective view of an alternate crane assembly utilizing bushings for adjustment.

FIG. 9 illustrates the replacement of a standard crane mast, jack and boom with a HOYER LIFTER 110. The HOYER LIFTER 110 comprises a mast 111 extending into a socket spacer 112. The socket spacer 112 is used to insure a snug fit between the swivel socket 32 and the base of the HOYER LIFTER mast 111. Further, an original HOYER base handle 113 extends outwardly from the mast 111 and is connected to the mast 111 via a HOYER LIFTER handle mounting bracket 114. The base handle 113 further includes an extended handle 115 attached thereto via at least one bushing 116. The mast 111, the spacer 112 and the swivel socket 32 may require a bolt to prevent unwanted rotation of the HOYER LIFTER mast 111 relative to the swivel socket 32. Further, the bolt or other locking device may be needed when the rotational position of the mast 111 is to be limited or of critical importance.

In the case of a quadriplegic operating the HOYER LIFTER 110 and bedside swivel socket 32 to accomplish an unassisted transfer, the handle of the original HOYER LIFTER needs to be modified to increase its mechanical advantages. For instance, the extended handle 115 configuration illustrated in FIG. 9 is desirable since it utilizes the base handle 113 in a manner which is easily assembled in a variety of configurations. Also, the base handle 113 can be slid to any location desired thereby changing the length of the handle 113. This can create a position which is comfortable to reach while suspended from the end of the boom 117. Further, this modification gives the suspended crane operator a level for the purpose of maneuvering himself/herself relative to the foundation of the swivel socket 32. In addition, the bushings 116 mounted to the base handle 113 can be positioned to change the height of the extended handle 115 relative to the base handle 113. It should be noted that a variety of different shapes and sizes of extension handles may be utilized depending on the users mobility and such that it is easy to grip. The boom 117 is positionally adjustable by a HOYER LIFTER hydraulic jack 118 which is in turn connected to the mast 111 at the mounting bracket 114 where the original base handle 113 is also connected.

Figure 11:
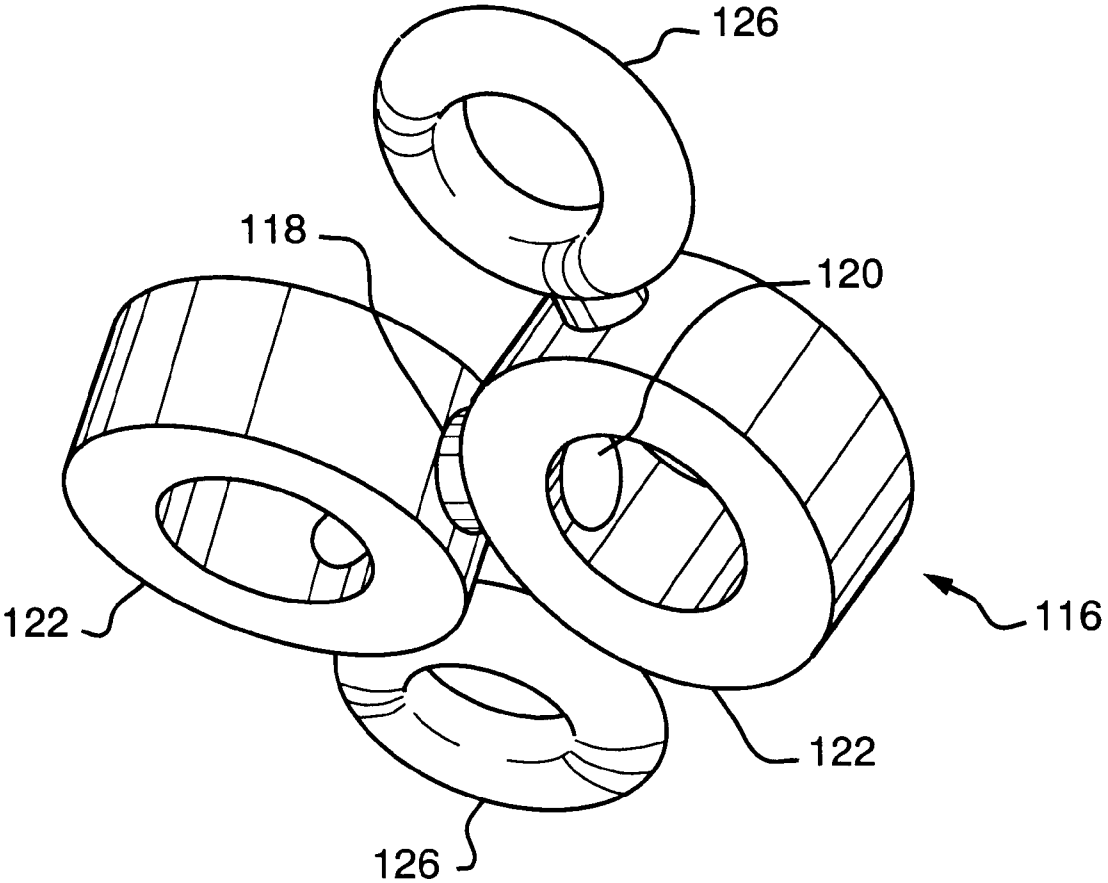
FIG. 11 is a perspective view of the two bushing combination of FIG. 10.

FIG. 11 illustrates bushing 116 utilized with a threaded rod 118 passing through threaded holes 120 to hold two collars 122 together. This allows the collars 122 to rotate about the threaded rod axis relative to each other. The use of the eye-bolts 126 is critical since they can be manipulated by a quadriplegic for the purpose of adjusting and removing the extension handle since there is no need for the additional use of a tightening tool as is the case with the use of typical set screw and Allen wrench. Further, they are readily available in most hardware stores and the eye of an eye-bolt can be utilized to support straps and other handling devices in a variety of locations on the base handle 113 and the extended handle 115.

Another aspect of the combination of the main mast swivel socket 32 and side operated crane is to utilize a pulley, wire, and a winch that can be either manually operated or motor driven. Such a lifting technique can be utilized instead of the hydraulic crane mechanism at a lower cost. The utilization of a simple bushing provides for the use of a large selection of preexisting cranes on the market, most of which fit into either the main mast swivel socket 32 or a crane mast socket 82 of the main boom 38. More specifically, the swivel socket 32 or the crane mast socket 82 are of slightly larger diameter then most human lifting cranes already in existence.. To utilize one of the existing cranes with either the swivel socket 32 or the crane mast socket 82, one simply needs to insert a bushing used as a spacer in to the swivel socket 32 or crane mast socket 82 before inserting a standard crane mast end.

THE BASE SUPPORT:

The main channel 22 is connected to the bed and further supported by a base support 24. The base support 24 is comprised of a vertical channel 140 and an inner member 142 wherein the vertical channel 140 is attached to the main channel 22 by at least one vertical channel support 143. Positioned next to or relatively close to the vertical channel 140 is a rod or ball screw linear actuator 144. The linear actuator 144 is attached to the main channel 22 via an upper motor mounting bolt 146 and further attached to the vertical channel 140 at a linear actuator drive motor 148. In one embodiment, the upper motor mounting bolt 146 is set directly into the main channel 22. However, it may be necessary to utilize an extension bracket which would allow the upper motor mounting bolt 146 to be set at a higher location thereby accounting for longer actuator stroke lengths and lower bed heights.

Extending from the linear actuator drive motor 148 are respective motor wires 150. Some of the motor wires 150 are used for hooking the linear actuator drive motor 148 to an outlet or other power source. Further, some of the other motor wires 150 are used for connecting the linear actuator drive motor 148 to a control assembly to be used by an individual operating the lift assembly 20. The motor wires 150 are typically supplied with the linear actuator drive motor 148 as a complete unit. However, various connectors can be used to make installation more simple. It is appropriate to use standard quick release connectors, such as ANDERSON connectors, to make installation and repair easier.

The linear actuator drive motor 148 is connected to the vertical channel 140 by a lower motor mounting bracket 152 and a respective bolt 154. The lower motor mounting bracket 152 may be eliminated in instances where the structure upon which the main mast swivel socket 32 is to be mounted is a stationary structure. The lower motor mounting bolt 154, as with all bolts used in the main mast swivel socket 32, the crane assembly 40, and the tables 34 and 36, is chosen from high quality bolts, such as a grade8 bolt, so as to withstand the enormous sheer forces involved with lifting and transferring an individual.

The linear actuator 144 and linear actuator drive motor 148 can be bought "off-the-shelf" from numerous motor companies, for example MOTION SYSTEMS. The exact stroke length and stroke speed may vary according to the application. For instance an INVACARE bed has a different height adjustment speed than a SCIO-TECH bed. In either case the motor must be prescribed for the exact application. In addition the user may want a socket mounted to a wheelchair which utilizes an entirely different stroke speed to lower the stabilizing base support 24. It should also be recognized that the linear actuator drive motor 148 may be eliminated in some applications. For instance, there are preexisting drive mechanisms on many hospital beds. In these cases it may be more efficient to utilize the preexisting drive source by making a linkage to drive the base support linear actuator. For large orders of the same bed type, the latter description of drive mechanism certainly will be more cost effective and less tedious then trying to synchronize stroke speeds. Furthermore it may become necessary to utilize a pressure activated limit switch to position the base support, in which case the base support can lag or precede the bed motion, depending upon whether the bed is raised or lowered.

In another illustrative embodiment, fixing the height of the bed can eliminate the need and/or reliance on an electrically operated motor. Typically the bed adjustment height is used to help the nurses get the patient in and out of bed during transfers. By using the swivel socket lift assembly 20, the bed can be fixed in position and the patient can be lifted, or lift himself/herself, to any height without added stress on anyone's back.

Positioned at the end of the vertical channel 140, distal from the main channel 22, is a bed foot plate 156. Also, there is a horizontal bed mounting brace 158 attached to the main channel 22 via a pair of main channel brackets 159. The horizontal mounting brace 158 extends outwardly from the side of the main channel 22 and can assist in securing the main channel 22 to the bed.

The horizontal bed mounting brace 158 may be eliminated depending on the strength of the supporting structure. Further, it may also be replaced by another mounting brace depending on the structure to which it is mounted.

The inner member 142 may need to be varied in length depending upon bed height, or to account for different stroke length motors depending on the amount of vertical height adjustment desired. It may also be made out of a different type of structural material, for instance rectangular steel. Here, the size of wall thickness of which will be determined by the exact nature of application of the swivel socket 32. Further, if the swivel socket 32 is to be utilized as a crane assembly support, then the size of the rectangular steel may vary according to the desired lifting capacity needed for a particular application.

THE FOOT:

The foot plate 156 may be varied in length, width and shape depending on the structure upon which the swivel socket 32 is mounted. For instance, if the swivel socket 32 is to be used to accommodate a portable crane as would be the case if the swivel socket 32 were to be attached to an electric wheelchair, then the foot plate 156 should be collapsible and of a lighter construction. In addition, a longer foot plate 156, on the base support 24, may be utilized with the rotational positioning bolts to eliminate the need for the counterweight 26. If the socket is used to support a sink or drawers the counterweight 26 may be eliminated.

A foot plate angle brace 166 may be needed for use with a longer foot plate 156 to assist in stabilizing the lift assembly 20. However, the foot plate angle brace 166 should be lower than the lowest point on the wheelchairs foot rest.

The main channel 22 may be replaced with another type of structural steel type, such as a rectangular structural steel, or entirely different configurations may be utilized. Further, if the swivel socket 32 were to be applied to a whirlpool bath or other similar structure, the main channel 22 may need to be bolted directly to the side of the whirlpool or other similar structure reducing the length of the main channel 22 significantly. Likewise, the main channel 22 might be associated with an operating table, for the purpose of creating a swivel socket 32 for a stabilizing arm which can hold and stabilize doctors movements. In this instance, the length of the main channel 22 may be reduced significantly because the need for a counterweight 26 may be eliminated.

The size of all parts may be varied for specific designs. As such, the angle iron used for cross bracing to the bed may be made out of plate steel sized for a specific application. Alternatively, it may be replaced by two cables wherein one cable is positioned on either side of the main channel 22. Here, the supporting tension would reduce the instability and possibility of buckling the angle iron cross bracing when acting in compression. However, not all mounting configurations will accept the cable supports. If the swivel socket 32 is to be near the head or foot of the bed, there will be not enough distance of existing bed frame for the cables to be mounted. However, if the swivel socket 32 is located near the center of the bed, the cable mounting configuration will provide a more efficient solution, given that bed frame is sufficient to handle the added stress.

Figure 5:
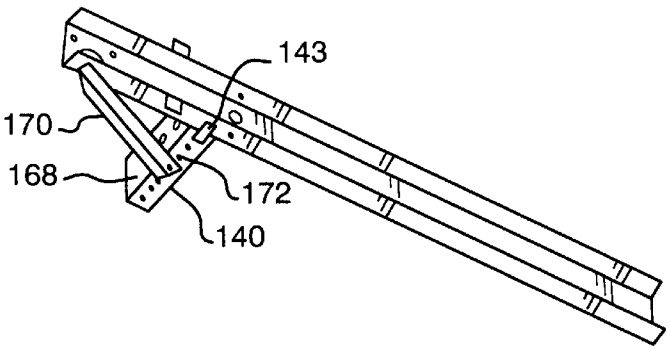
FIG. 5 is a perspective view illustrating the main channel assembly of the lift assembly.

FIG. 5 illustrates a vertical channel kick-out plate 168 primarily to be used with the applications requiring a motor driven foot plate. In the case of a stationary foot plate, the vertical kick-out plate 168 can be eliminated because the foot height adjustment bolts will be utilized instead. The plate steel for the vertical channel kick-out plate 168 and the vertical channel 140 may be replaced with rectangular structural steel. In this instance, the inner member 142 may need to be replaced with a type of rectangular steel similar and of smaller size.

A main vertical angle brace 170 is used to add further stability to the lift assembly 20 by forming an additional connection between the vertical channel 140 and the main channel 22. One end of the main vertical angle brace 170 is connected to the vertical channel 140 in one of a series of base support height adjustment holes 172. The distal end is then connected to the main channel 22 in a set position. As the vertical channel 140 is raised or lowered, the main vertical angle brace 170 needs to be repositioned along the vertical channel 140 accordingly. The main vertical angle brace 170 can be made with a different selection of material such as plate or box steel depending on the application and supporting load weight. In some cases it may be eliminated altogether.

The base support height adjustment holes 172 may be eliminated if the linear actuator drive motor 148 and vertical channel kick-out plate 168 are utilized in the design. Another illustrative embodiment includes the height adjustment holes 172 and the vertical channel kick-out plate 168 with the option of installing the linear actuator drive motor 148 if it is necessary. Further, more adjustment holes may be added for various mounting structure heights.

At least one height adjustment bolt 174 is used to connect the main vertical angle brace 170 to the vertical channel 140. The height adjustment bolts 174 are to be chosen from high quality materials and sizes, such as grade8 bolts, that extend entirely through the vertical channel 140 and inner member 142. If the vertical channel kick-out plate 168 is not used, then a plurality of bolts may be utilized for stability.

Although the bedside swivel socket is designed to be attached to pre-existing structures, it is certainly conceivable to build a bed or other structure with the swivel socket incorporated into the design. Such a design will want incorporate the concept of using the bed as part or all of the supporting foundation. Other designs will also want to incorporate the concept of allowing foot room for the wheelchair bound individual. In addition, designs may wish want to incorporate the concept of making the crane assembly less obtrusive by incorporating the crane assembly into the bed structure so well that it is entirely hidden. This can be accomplished by either building the crane assembly into the head board or foot board, or by making the crane assembly entirely collapse into the side of the bed. Alternative techniques for hiding the obtrusive looking crane assembly would be cloaking the crane assembly and swivel socket with some sort of puppet art form. For instance the lifting assembly could appear on the surface to be an animal structure such as an elephant or friendly, dinosaur for use in the rehabilitation hospitals where there are children. Other designs could also be used without departing from the scope of this invention.

While one use of the swivel socket is for a human lifting crane, the swivel socket is designed as a multifaceted socket which can support many devices used by humans in the health field. In addition to the already disclosed alternate apparatus supported by the swivel socket, the following non-inclusive list describes other apparatus that might take advantage of the capabilities of the swivel socket, including support for: a book for reading, a computer, a TV, a VCR, a stereo, remote controls, a patient safety switch, sets of pockets for many items including but not limited to a first aid kit, catheter kit, a bowel management kit, a cellular phone, a light switch, or a light itself, and various controls for people with verbal communication problems. Further, the swivel socket can be mounted to a bed frame, wheelchair, prone standing device, exercise electric stimulus device, weight lifting exercise machine, a car seat, a whirl pool, a rowing machine or an actual rowing boat, an easy recliner chair, a shower or bath tub, an exercise mattress as in rehab hospitals, an operating table for efficient dependable and reliable movement of patient or operating tools.

Although electric motors have been disclosed for operating and adjusting various mechanical components of the lift assembly, an alternative power source, such as human power, can be utilized. In this instance, the individual user can manipulate and operate the assembly, or various components of the assembly, directly with their own power. In instances when this is not readily achievable, storage of the individual power for later usage may be desirable. Components to be installed with the lift assembly so as to allow the use of human power include, but are not limited to, an exercise pump or blow tube, a pressure vessel, battery, fly wheel, fluid reservoir, rank mechanisms and the like.

Further, components to transfer energy include, but are not limited to, electric, hydraulic, gas, air over oil and the like.

All parts may be made of different material including but not limited to metallic alloys, aluminum, tungsten, steel, stainless steel, composite steels, plastics, fiberglass, composite plastics, reinforced plastic, ceramic reinforced with metal fibers, ceramic reinforce fiber glass, cement reinforced fiber glass, and other materials can be used so long as their inherent structural properties are such as to meet the needs of the structures for which they are used.

Although the present invention has been described with respect to illustrative embodiments thereof, workers skilled in the art will recognize that various other modifications, additions and/or omissions may be made in form and detail without departing from the spirit and scope of the invention.

What is claimed is:

1. A swivel socket crane lift assembly preferably utilized to provide assistance for a physically impaired individual to transfer said individual from one location to another, such as from a bed to another piece of equipment utilized by said individual, such as a wheelchair or the like, said swivel socket crane lift assembly comprising:

a main channel having a first end and a second end wherein said main channel connects the assembly to said bed;

a base support being adjustably downwardly extendable and perpendicularly attached to said first end of said main channel; and an upper lift assembly being perpendicularly disposed and attached to said main channel towards said first end and extending from said main channel in a direction opposite said base support, wherein said base support is recessed under said bed to allow said individual to approach said bed while in a wheelchair without interference with said base support.

2. The swivel socket crane lift assembly of claim 1 further comprising:

a counterweight connected to said main channel at said second end, said counterweight having a sufficient size and weight to keep the bed from tipping or rotating when said lift assembly is in use.

3. The swivel socket crane lift assembly of claim 1 wherein said upper lift assembly comprises:

a main axle assembly having a main mast swivel socket into which a main mast is inserted;

a main boom having a first end which comprises a support sleeve, which circumscribes said main mast; and a second end to which is mounted a crane, which extends away from said boom in a direction opposite the ground.

4. The swivel socket crane lift assembly of claim 3 wherein said main axle assembly further comprises:

a mounting surface fastened to said main channel;

a rotational bearing assembly rotationally attached to said mounting surface;

a rotational disk being attached to said rotational bearing assembly, upon which said main mast swivel socket is mounted, whereby said main mast swivel socket is rotationally position able about the axis of the main mast through said bearing assembly.

5. The swivel socket crane lift assembly of claim 4 wherein said rotational bearing assembly comprises:

a plurality of socket support fins extending outwardly from said rotational bearing.

6. The swivel socket crane lift assembly of claim 4, further comprising a motor, which rotationally positions said swivel socket through a set of gears mounted on said motor and on said rotational disk.

7. The swivel socket crane lift assembly of claim 3 wherein said upper lift assembly further comprises:

at least one table rotationally attached to said main mast.

8. The upper lift assembly of claim 7 further comprising:

at least one table support having a proximal end comprising a support sleeve, said support sleeve circumscribing said main mast connected to and supporting said table.

9. The swivel socket crane lift assembly of claim 3 wherein said upper lift assembly further comprises two tables, rotationally attached to said main mast above and below said main boom.

10. The main mast swivel socket of claim 3 further comprising:

a rotational position mounting stop comprising at least one mounting bolt fixed in said main channel and of sufficient length to extend beyond said mounting surface and at least one bolt mounted in one or more rotational position holes of said rotational disk to limit the rotational movement of said main boom.

11. The swivel socket crane lift assembly of claim 3 wherein said crane comprises a handle for operating said crane and wherein said handle further comprises an extended handle attached to said crane operating handle to provide greater leverage to assist an individual in operating said crane.

12. The swivel socket crane lift assembly of claim 11 wherein said extended handle is attached to said crane operating handle with at least one bushing to allow said extended handle to be attached and removed from said crane operating handle.

13. The swivel socket crane lift assembly of claim 3 wherein said crane is operated using at least one motor.

14. The swivel socket assembly of claim 1 wherein said base support comprises:

a vertical channel having proximal end and distal end, said proximal end being attached to said main channel by at least one vertical channel support; and an inner member being slidably disposed within said vertical channel support such that sliding of said vertical channel support acts to extend said base support.

15. The base support of claim 14 further comprising:

a linear actuator attached to said main channel;

a linear actuator drive motor, attached to said linear actuator.

16. The base support of claim 15 further comprising;

a lower motor mounting bracket attaching said linear actuator drive motor to said vertical channel.

17. The base support of claim 15 further comprising:

at least one of a plurality of motor wires which connect said linear actuator to a power source.

18. The base support of claim 15 further comprising:

at least one of a plurality of motor wires which connect said linear actuator drive motor to a control assembly.

19. The base support of claim 14 further comprising:

a foot plate being connected to said distal end of said vertical channel and extending parallel to and touching the ground.

20. The base support of claim 16 further comprising:

a foot plate angle brace attached to said foot plate and said vertical support.

* * * * *